US010575597B2

(12) United States Patent
Boughner et al.

(10) Patent No.: US 10,575,597 B2
(45) Date of Patent: Mar. 3, 2020

(54) DEBRIS RESISTANT SEATBELT BUCKLE DEVICE

(71) Applicant: AUTOLIV ASP, INC., Ogden, UT (US)

(72) Inventors: Jonathon Boughner, Lake Orion, MI (US); Jon E. Burrow, Ortonville, MI (US)

(73) Assignee: AUTOLIV ASP, INC., Ogden, UT (US)

( * ) Notice: Subject to any disclaimer, the term of this patent is extended or adjusted under 35 U.S.C. 154(b) by 59 days.

(21) Appl. No.: 15/806,898

(22) Filed: Nov. 8, 2017

(65) Prior Publication Data

US 2019/0133260 A1 May 9, 2019

(51) Int. Cl.
*A44B 11/25* (2006.01)

(52) U.S. Cl.
CPC ..... *A44B 11/2523* (2013.01); *A44B 11/2569* (2013.01)

(58) Field of Classification Search
CPC ..... A44B 11/2523; A44B 11/2569; Y10T 24/45644; Y10T 24/45665
See application file for complete search history.

(56) References Cited

U.S. PATENT DOCUMENTS 5,357,658 A * 10/1994 Tanaka ..... A44B 11/2523 24/633
5,522,619 A * 6/1996 Collins ..... A44B 11/2503 24/633
5,742,987 A * 4/1998 Mikulec ..... A44B 11/2523 24/633
6,701,587 B1 * 3/2004 Sato ..... A44B 11/2523 24/633
7,124,480 B2 * 10/2006 Kawai ..... A44B 11/2523 24/633
7,543,363 B2 * 6/2009 Webber ..... A44B 11/2523 24/633
8,978,214 B2 3/2015 Kataoka et al.
9,346,433 B2 5/2016 You
9,402,446 B2 * 8/2016 Haas ..... A44B 11/2523
2007/0044283 A1 * 3/2007 Longley ..... A44B 11/2515 24/633

(Continued)

*Primary Examiner* — Robert Sandy
*Assistant Examiner* — Rowland Do
(74) *Attorney, Agent, or Firm* — Stephen T. Olson; Harness, Dickey & Pierce, P.L.C.

(57) ABSTRACT

A seatbelt buckle device includes a housing, a frame, a latching arrangement and a release button. The frame includes a bottom wall and first and second laterally spaced walls. The latching arrangement selectively retains a latch plate within the housing. The release button is movable between a latched position and an unlatched position. A proximal end, a distal end and first and second laterally spaced apart legs of the release button cooperate to define an opening into which a projecting portion distally from the proximal end. At least one shield member laterally extends from the projection portion toward the first and second laterally spaced apart legs. Each shield member includes an outboard side spaced from an adjacent leg of the first and second legs by a gap. Each gap slidingly receives one of the first and second laterally spaced walls of the frame.

18 Claims, 5 Drawing Sheets

(56) References Cited

U.S. PATENT DOCUMENTS

| | | | | |
|---|---|---|---|---|
| 2012/0144630 | A1* | 6/2012 | Nimura | A44B 11/2523<br>24/593.1 |
| 2012/0324685 | A1* | 12/2012 | Kataoka | A44B 11/2523<br>24/637 |
| 2015/0166005 | A1* | 6/2015 | You | A44B 11/2523<br>24/642 |

* cited by examiner

DEBRIS RESISTANT SEATBELT BUCKLE DEVICE

FIELD

The present disclosure relates to a seatbelt buckle device adapted for use as part of a motor vehicle occupant restraint system. More particularly, the present disclosure relates to a debris resistant seatbelt buckle device.

BACKGROUND

This section provides background information related to the present disclosure which is not necessarily prior art.

Various seatbelt assemblies are well known for use in motor vehicles. Examples of such known seatbelt assemblies are shown in commonly U.S. Pat. Nos. 8,978,214, 9,346,433 and U.S. Publication No. 2016-0120268 which are hereby incorporated by reference as if fully set forth herein. Present systems have certain common elements including seatbelt webbing that extends across the upper and lower torso of the occupant, and a retractor for allowing protraction and retraction of the webbing so that the belt may adapt to different sizes of occupants and be conveniently out of the way when not being used. Seatbelt assemblies further typically include a buckle which releasably attaches to a latch plate.

Seatbelt assemblies must be securely affixed to motor vehicle structural elements in order to provide the necessary restraint effect in vehicle impact conditions and further to meet government regulations. Further, seatbelt assemblies must securely retain an occupant within its seat, while also allowing the occupant easy ingress and egress from the seat under a variety of conditions and situations.

Typical seatbelt assemblies include a buckle that is securely mounted to a vehicle structure, such as a seat frame or the floor of the occupant compartment. The buckle typically includes a slot that is sized to receive and retain a latch plate.

The latch plate is typically attached to the seatbelt webbing. The seatbelt webbing is typically fixed to the vehicle structure at one end, and the opposite end is typically fixed to a retractor having an internal spool that is configured to protract and retract the webbing in response to various loads. The latch plate is typically attached by passing the seatbelt webbing through an elongate opening or slot, such that the latch plate can slide along the webbing and be adjusted relative to the size of the occupant. The latch plate is typically attached to webbing such that the latch plate remains on the webbing, whether the seatbelt is in the buckled or unbuckled configuration.

The buckle is typically in the form of a housing that includes a pushbutton. A single slot is provided at the top of the buckle and defined between the pushbutton and the housing, into which a single latch plate is inserted. In other forms, the pushbutton is provided on the side of the housing, and the housing defines the slot at the top of the buckle.

Because the seatbelt is inherently inserted and removed multiple times through the course of its life, there are prolonged instances where the seatbelt is in an unbuckled condition. In this condition, the slot at the top of the housing is open and capable of receiving the latch plate when buckling is desired by the occupant. The slot is susceptible to debris being inserted into slot or inadvertently falling into the slot. Such debris can include coins, pins, paperclips, gravel, hairpins, rubber bands, spilled liquid and other similar items. Debris becoming lodged within the buckle may potentially interfere with proper buckle operation.

While known seatbelt assemblies, including U.S. Pat. Nos. 8,978,214, 9,346,433 and U.S. Publication No. 2016-0120268, have proven to be suitable for their intended uses, a continuous need for improvement in the relevant art remains.

SUMMARY

This section provides a general summary of the disclosure, and is not a comprehensive disclosure of its full scope or all of its features.

In accordance with one aspect, the present teachings provide a seatbelt buckle device for a seatbelt system of a motor vehicle. The seatbelt buckle device includes a housing, a frame, a latching arrangement and a release button. The frame is disposed in the housing, fixed in position in the housing and includes a bottom wall and first and second laterally spaced walls. The latching arrangement is operatively associated with the frame for selectively retaining a latch plate within the housing. The release button is in sliding engagement with the frame and movable between a latched position and an unlatched position. The release button includes a proximal end, a distal end and a first and second laterally spaced apart legs extending between the proximal and distal ends. The proximal end, the distal end and the first and second laterally spaced apart legs cooperate to define an opening into which a projecting portion distally from the proximal end. At least one shield member laterally extends from the projection portion toward one of the first and second laterally spaced apart legs. The at least one shield member includes an outboard side spaced from an adjacent leg of the first and second legs by a gap, each gap slidingly receiving one of the first and second laterally spaced walls of the frame.

In accordance with another aspect, the present teachings provide a seatbelt buckle device of a seatbelt system having a housing, a frame, a latching arrangement and a release button. The frame is disposed within the housing and includes first and second longitudinally extending side walls defining first and second longitudinally extending grooves, respectively. The latching arrangement is operatively associated with the frame for selectively retaining a latch plate within the housing and includes a counterweight rotatably coupled to the frame. The release button is movable within the housing between a latched position and an unlatched position and includes a proximal end laterally extending between first and second laterally spaced apart legs, a projecting portion distally extending from the proximal end and defines a groove for receiving a portion of the counterweight, first and second guiding portions distally extending from the proximal end and slidingly received in the first and second first and second longitudinally extending grooves, respectively, and first and second shield members laterally disposed between the projection portion and the first and second laterally spaced apart legs, respectively. The first shield member is laterally spaced from the first laterally spaced apart leg by a first gap and the second shield member laterally spaced from the second laterally spaced apart leg by a second gap, the first and second gaps are sized to receive the first and second longitudinally extending side walls of the frame, respectively.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
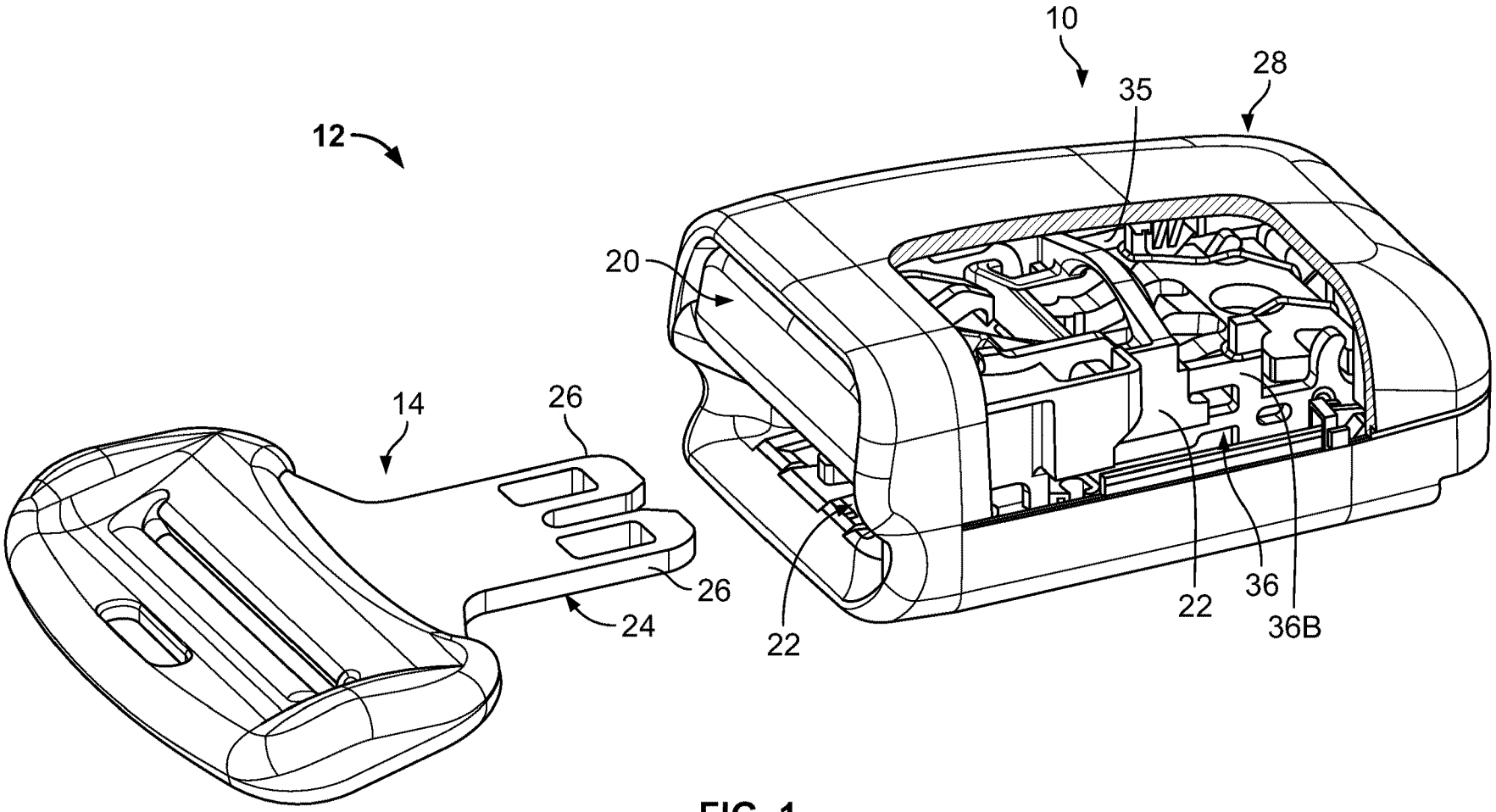
FIG. 1 is a perspective view of a seatbelt buckle device according to the present teachings, the seatbelt buckle device shown partially cut-away and operatively associated with a latch plate prior to insertion of the latch plate.
Figure 2:
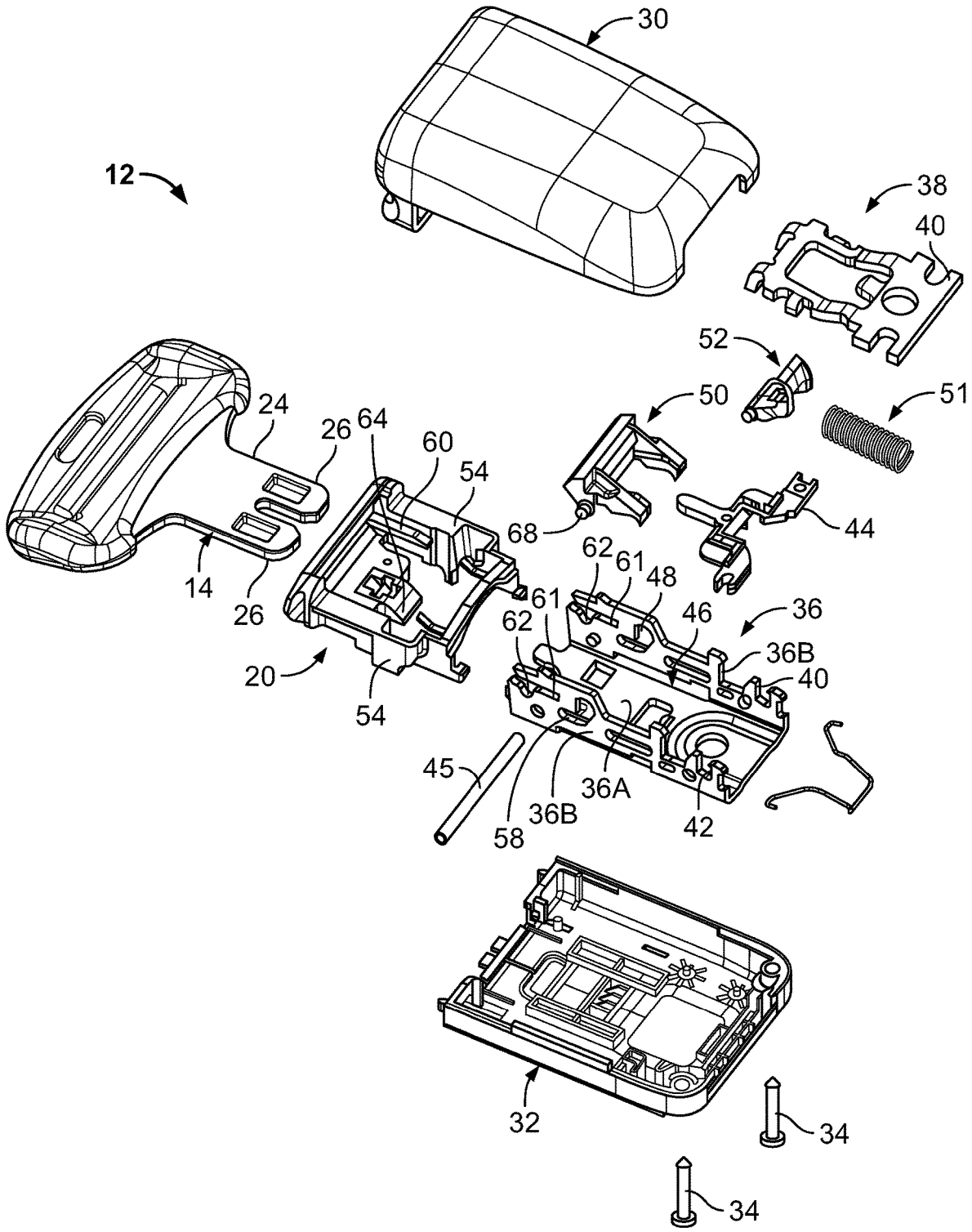
FIG. 2 is an exploded perspective view of the seatbelt buckle device and latch plate of FIG. 1.

Example embodiments will now be described more fully with reference to the accompanying drawings.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that the example embodiment should not be construed to limit the scope of the present disclosure. Well-known processes, well-known device structures, and well-known technologies are not described herein in detail.

With initial reference to FIGS. 1 through 5, a seatbelt buckle device for a seat belt in accordance with the present teachings is illustrated and generally identified at reference character 10. The seatbelt buckle device 10 is part of an occupant restraint system 12 of a motor vehicle that further includes a latch plate 14. The latch plate 14 may be carried by a seatbelt of the motor vehicle in a conventional manner. The seatbelt buckle device 10 may be conventionally mounting to a vehicle seat or a frame of the vehicle, for example.

The seatbelt buckle device 10 is illustrated to generally include a release button 20 that translates with the seatbelt buckle device 10 between a latched position and an unlatched position. As will become more apparent below, the release button 20 may be particularly adapted to resist contamination of the seatbelt buckle device 10 by debris that may be inadvertently introduced into a slot 22 (see FIG. 1) of the seatbelt buckle device 10.

The latch plate 14 illustrated in the drawings will be understood to be conventional insofar as the present teachings are concerned. As shown, the latch plate 14 may include a tongue portion 24 having a pair of fingers 26. One suitable latch plate 14 is shown and described in common assigned US Publication No. 2016-0120268. It will be understood, however, that the present teachings may be used with other latch plates, including but not limited to conventional latch plates having a single tongue portion or latch plates with three or more fingers, for example.

The seatbelt buckle device 10 has a generally rectangular cartridge shape defined by a housing or cover 28 having an upper cover portion 30 and a lower cover portion 32. The upper cover portion 30 and the lower cover portion 32 may be coupled to one another with fasteners 34 to provide a generally enclosed structure. Of course, other manners of providing an enclosed space could also be utilized, such as through injection molding the desired shape. It will be appreciated that other known manners for providing an enclosed space for the seatbelt buckle device 10 are contemplated in this disclosure.

The housing 28 also defines an interior cavity 35. The interior cavity 35 is sized to accommodate a frame 36 and a latching arrangement associated with the frame 36 for retaining the latch plate 14 within the housing 28. Some of components of the latching arrangement may fixed be relative to the housing 28, whereas other of the components may be moveable relative to the housing 28.

The release button 20 translates within the seatbelt buckle device 10 relative to the housing 28. The release button 20 mechanically cooperates with the various components the latching arrangement of the seatbelt buckle device 10 to selectively retain the latch plate 14 relative to the seatbelt buckle device 10. These components are described in further detail below. To the extent not otherwise described herein, it will be understood that the construction and operation of the various internal components of the buckle assembly 10 are described in U.S. Pat. No. 8,978,214.

Figure 3:
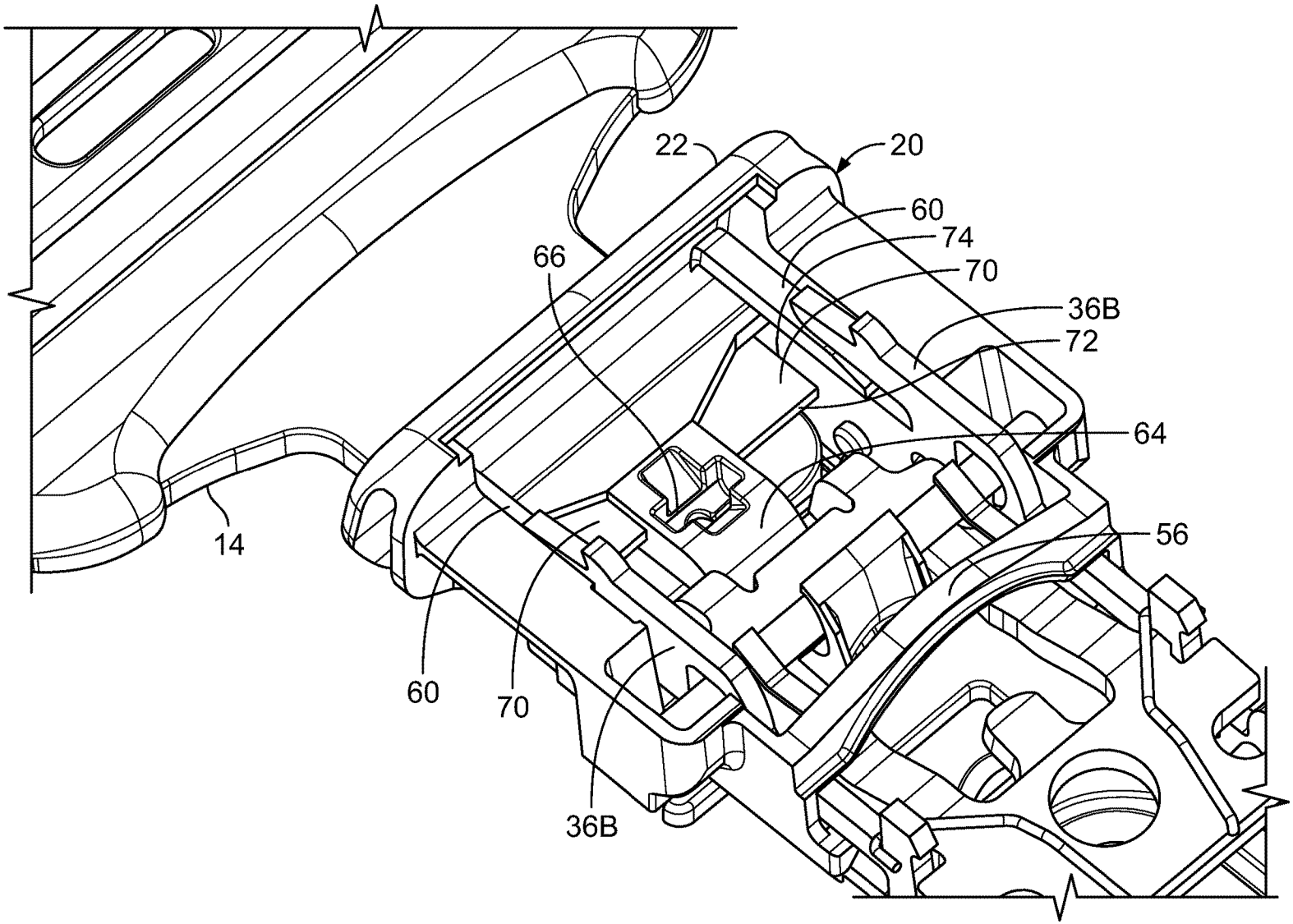
FIG. 3 is another perspective view of the seatbelt buckle device and latch plate of FIG. 1, the seatbelt buckle device shown with a cover removed for purposes of illustration and shown operatively receiving the latch plate in a latched state.
Figure 4:
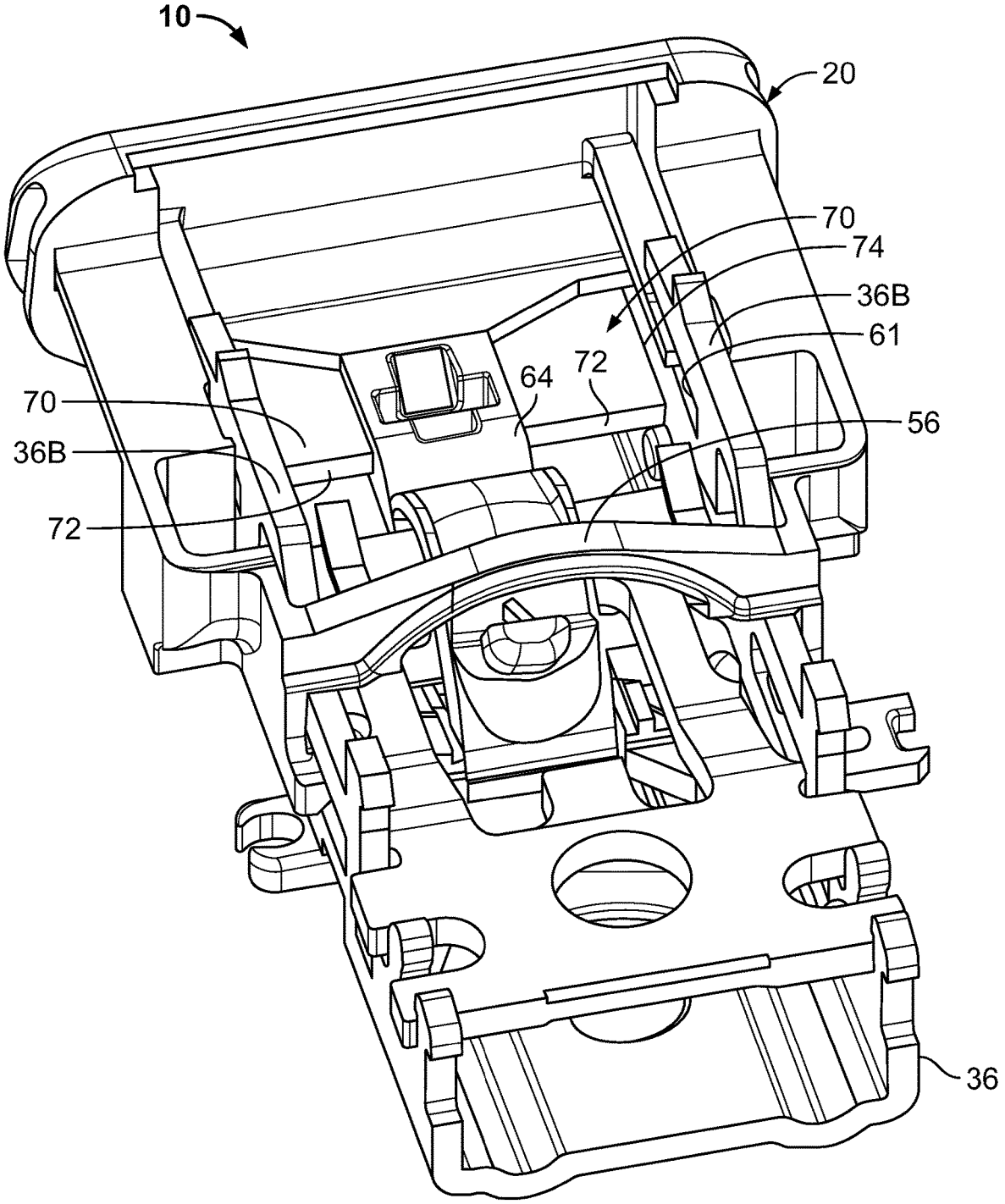
FIG. 4 is perspective view of a portion of the seatbelt buckle device of FIG. 1, the seatbelt buckle device shown in an unlatched state and again shown with the cover removed for purposes of illustration.

The seatbelt buckle device 10 is operative in a latched state and an unlatched state. The unlatched state is shown in FIG. 3, for example. The latched state is shown in FIG. 4, for example. In the latched state, the buckle seatbelt buckle device 10 prevents the latch plate 14 from being removed from the buckle seatbelt buckle device 10. In the unlatched state, the latch plate 14 may be inserted into the buckle seatbelt buckle device 10 or freely removed from the buckle seatbelt buckle device 10.

The release button 20 and the latching components are biased toward the latched state (e.g., biased to a latched position), such that when the release button 20 is not pressed, the internal components of the seatbelt buckle device 10 will prevent an inserted latch plate 14 from being removed from the seatbelt buckle device 10. Pressing the release button 20 against its bias and toward an unlatched position will in turn force the internal components against their biases and into the unlatched state, thereby allowing the latch plate 14 to be freely removed from the buckle seatbelt buckle device 10.

The internal components may also be arranged to allow the latch plate 14 to be inserted into the seatbelt buckle device 10 without requiring that the release button 20 be manually depressed, as is typical in traditional buckles. The latch plate 14 will cause the components to move upon contacting them, forcing them against their biases. Once the latch plate 14 has been inserted a predetermined distance, the biases of the internal components will cause the internal components to return the seatbelt buckle device 10 to the latched state, thereby retaining the latch plate 14 in the latched state.

The internal components of the seatbelt buckle device 10 include a base member 36 and a latch member 38. The latch member 38 is rotatably coupled to the base member 36. The base member 36 is shown to include a bottom side 36A and first and second lateral sides 36B. The latch member 38 includes a hinge protrusion 40 that is rotatably inserted in hinge holes 42 of the base member 36. The internal components further include an ejector 44 and a locking bar 45. The ejector 44 is inserted into an ejector slot 46 of the base member 36. The locking bar 45 is inserted in a moving slot 48 of the base member 36. An inertial lever or counterweight 50 is provided that is coupled to the release button 20 and the locking bar 45. When the release button 20 is depressed, the locking bar 45 will move along the moving slot 48, forcing the latch member 38 to pivot to an unlatched position for releasing the latch plate 14.

An ejector spring 51 is disposed between the latch member 38 and a cantilever 52. The ejector 44 is disposed between the latch member 38 and the bottom wall 36A of the frame member 36. The ejector 44 is configured for sliding in the attachment-detachment direction of the tongue plate 14 on the bottom wall 36A of the frame member 36. When the tongue plate 14 is inserted into the housing 28, the ejector 44 is brought into contact with the end portion of the tongue plate 14 and pushed there against and slides within the housing 28. Further, when latching of the tongue plate 14 by the latch member 38 is released, the ejector 44 is biased by the ejector spring 51 and slides from the rear side inside the housing 28 toward the front of the housing 28. As the ejector 44 slides in this manner, the tongue plate 14 is pushed out of the housing 28.

The release button 20 has a generally rectangular shape defined by a proximal end 20A, a distal end 56, and first and second laterally spaced legs 54 extending between the proximal end 20A and the distal end 56. In the embodiment illustrated, the distal end is an arch-like projection 56. The arch-like projection 56 laterally connects the first and second laterally spaced legs. The proximal end 20A is exposed to an outside of the seatbelt buckle device 10 and may be engaged by a user to translate the release button 20 from the latched position to the unlatched position.

The legs 54 of the release button 20 slide on the outer sides of the side walls 36B of the frame 36. End portions of the lock bar 45 may laterally extend from the frame 36 and engage apertures in inner sides of the legs 54 of the release button 20. When the release button 20 translates in into the buckle seatbelt buckle device 10, the lock bar 45 is pushed in the direction into the buckle assembly 10 by a surface of these recesses, comes into contact with a curved edge of a guide hole 48, and moves upward along this edge. As a result, pressure acting from the latch member 38 on the tongue plate 14 under the effect of the lock bar 45 is released and latching of the tongue plate 14 is released.

A guiding portion 60 is provided on the inner side of each leg 54. The guiding portions 60 protrude along the corresponding side wall 36B of the frame 36 and extend toward the distal ends of the legs 54. The guiding portions 60 are received in longitudinally extending grooves 61 formed in the side walls 36B of the frame 36. When the release button 20 translates, the guiding portions 60 are guided by the longitudinally extending grooves 61. In this manner, the release button 20 can slide parallel to the side walls 36B and the bottom wall 36A of the frame 36.

The release button 20 is shown to further include a projecting portion 64 extending into a central opening defined by the release button 20, arch-like projection 56 and first and second laterally spaced apart legs 54. The projecting portion 64 extends from the proximal end 20A in the direction into the seat buckle device assembly 10 adjacent the bottom wall 36A of the frame 36. In the embodiment illustrated, the projecting portion 64 is laterally centered on a longitudinally central midline A of the release button 20. The projecting portion 64 includes a ramped distal end and has an upper surface that defines a bearing groove 66. A first rotating shaft (not particularly shown) of the counterweight 50 engages the bearing groove 66. The counterweight 50 functions as a weight acting against the release button 20. A second rotating shaft 68 of the counterweight 50 rotates in the housing 28, following the sliding movement of the release button 20. The second rotating shaft 68 is inserted into concave grooves 62 provided in the side walls 36B of the frame 36 and enable rotation of the counterweight 50 with respect to the frame 36 and housing 28. The first rotating shaft is engaged with the bearing groove 66 provided in the projecting portion 64 of the release button 20. The first rotating shaft 68 receives the force from the sliding release button 20, rotates the counterweight 50 with respect to the release button 20, and also rotates the counterweight 50 with respect to the housing 28 about the second rotating shaft 68.

Figure 5:
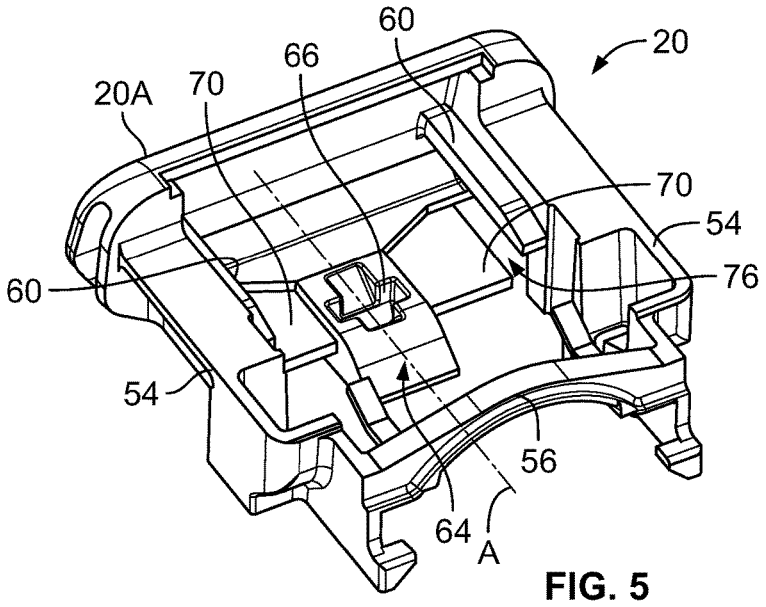
FIG. 5 is a perspective view of a button of the seatbelt buckle device of FIG. 1.

As perhaps most clearly shown in the enlarged views of FIGS. 3-5, the release button 20 further at least one shield member 70 for preventing contaminants from reaching an underside or backside of the release button 20. In the embodiment illustrated, the release button 20 includes a pair of shield members 70. The shield members 70 distally extend from the proximal end 20A and are each laterally located between the projecting portion 64 and one of the side walls 36B of the frame 36. In this regard, the groove 66 defined by the projecting portion 64 is laterally disposed between the shield members 70. Both of the shield members 70 are generally planar in shape and include a forward or distal side 72 and a lateral or outboard side 74. The outboard side 74 is spaced from the adjacent leg 54 by a gap 76 (see FIG. 5, for example) that sliding receives the corresponding sidewall 36B of the frame 36. The guiding portions 60 of the release button 20 are positioned above the gaps 76. In a downward direction, the lateral space between the projection portion 64 and the legs 54 is shielded by the shield members 70 and the guiding portions 60. Explaining further, the guiding portions 60 may have a width at least as great as the corresponding gap 76.

In the embodiment illustrated, the release button 20 maybe unitarily formed of a plastic material to include the shield members 70. For example, the release button 20 may be injected molded. It will be appreciated, however, release button 20 may be formed with alternative materials or with an alternative process within the scope of the present teachings. It will also be appreciated that the shield members 70 may be discrete members attached to a remainder of the release button 20 through a secondary operation.

Figure 6:
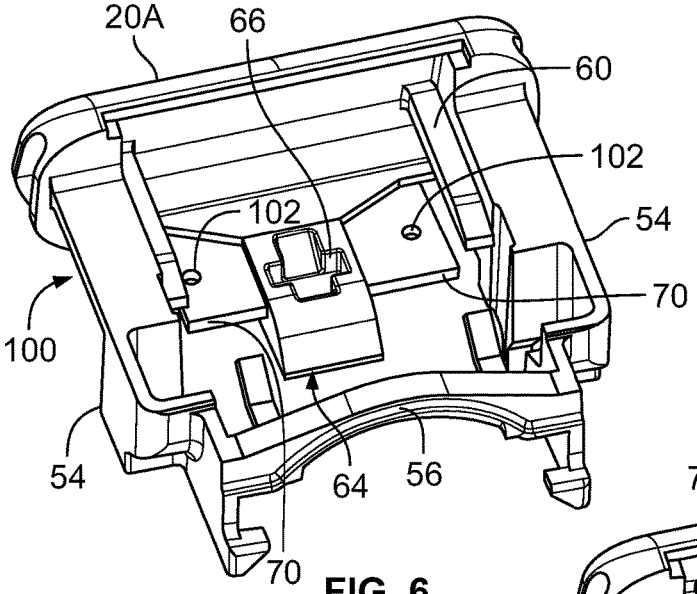
FIG. 6 is a perspective view similar to FIG. 5 illustrating an alternative button for a seatbelt buckle device of the present teachings.

Turning to FIG. 6, another release button in accordance with the present teachings is shown and generally identified at reference character 100. In view of the similarities between the release button 100 and the release button 20, like reference characters have been used to identify like elements. The release button 100 differs from the release button 20 by incorporating a drain hole 102 in one or more of the shield members 70. The drain holes 102 prevent liquid contaminants from sitting on a top surface of the shield members 70. As shown, the drain holes are circular in shape. It will be understood, however, that the drain holes may be of any suitable shape. It will also be understood that each of the shield members 70 may incorporate a plurality of drain holes 102. For example, the shield members 70 may be constructed of a wire mesh material within the scope of the present teachings.

Figure 7:
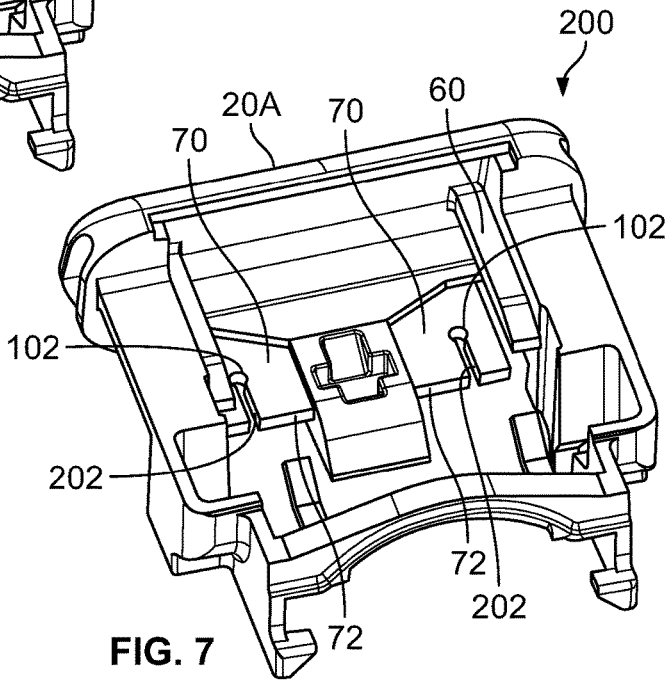
FIG. 7 is another perspective view similar to FIG. 5 illustrating another alternative button for a seatbelt buckle device of the present teachings.

Turning to FIG. 7, another release button in accordance with the present teachings is shown and generally identified at reference character 200. Again, like reference characters have been used to identify like elements in view of the similarities between the release button 200 and the release buttons 20 and 100. The release button 200 differs from the release button 100 by further incorporating a slot 202 forwardly extending from one or more of the drain holes. The slots 202 extend to the forward side 72 of the respective shield member 70.

Accordingly, it will be now appreciated that the present teachings provide a seatbelt buckle device 10 for resisting debris that may be inadvertently introduced into the slot 22. The release button 20 of the seatbelt buckle device 10 precludes small objects from protruding into the seatbelt buckle device 10 in such a manner to jeopardize functionality. Explaining further, the release button 20 may be configured to prevent small items from reaching a backside thereof. The release button 20 may be optionally configured to prevent liquid contaminants from sitting on the top side of a shield.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A seatbelt buckle device for a seatbelt system of a motor vehicle, the seatbelt buckle device comprising:

a housing;

a frame disposed in the housing, the frame fixed in position in the housing and including a bottom wall and first and second laterally spaced walls;

a latching arrangement operatively associated with the frame for selectively retaining a latch plate within the housing; and a release button in sliding engagement with the frame and movable between a latched position and an unlatched position, the release button includes a proximal end, a distal end and a first and second laterally spaced apart legs extending between the proximal and distal ends, the proximal end, the distal end and the first and second laterally spaced apart legs cooperating to define an opening, the release button further including a projecting portion distally extending into the opening from the proximal end and at least one shield member laterally extending from the projecting portion toward one of the first and second laterally spaced apart legs, wherein the at least one shield member includes at least one drain hole extending therethrough, and wherein the at least one shield member further includes a slot associated with the at least one drain hole.

2. The seatbelt buckle device of claim 1, wherein the at least one shield member includes first and second shield members.

3. The seatbelt buckle device of claim 2, wherein the projecting portion is laterally positioned between the first and second shield members.

4. The seatbelt buckle device of claim 3, wherein the projecting portion distally extends farther than the first and second shield members and has a thickness greater than both of the first and second shield members.

5. The seatbelt buckle device of claim 2, wherein the first shield member includes a first drain hole and a first slot associated with the first drain hole and the second shield member includes a second drain hole and a second slot associated with the second drain hole.

6. The seatbelt buckle device of claim 1, wherein the projecting portion extends in the direction farther than the at least one shield member and having a thickness r-eat greater than the at least one shield member.

7. The seatbelt buckle device of claim 1, wherein the slot extends from the drain hole to a forward side of the at least one shield member.

8. The seatbelt buckle device of claim 1, wherein the at least one shield member includes an outboard side spaced from an adjacent leg of the first and second legs by a gap, each gap slidingly receiving one of the first and second laterally spaced walls of the frame.

9. A seatbelt buckle device for a seatbelt system of a motor vehicle, the seatbelt buckle device comprising:

a housing;

a frame disposed in the housing, the frame fixed in position in the housing and including a bottom wall and first and second laterally spaced walls;

a latching arrangement operatively associated with the frame for selectively retaining a latch plate within the housing; and a release button in sliding engagement with the frame and movable between a latched position and an unlatched position, the release button includes a proximal end, a distal end and a first and second laterally spaced apart legs extending between the proximal and distal ends, the proximal end, the distal end and the first and second laterally spaced apart legs cooperating to define an opening, the release button further including a projecting portion distally extending into the opening from the proximal end and at least one shield member laterally extending from the projecting portion toward one of the first and second laterally spaced apart legs, the at least one shield member including an outboard side spaced from an adjacent leg of the first and second legs by a gap, each gap slidingly receiving one of the first and second laterally spaced walls of the frame, wherein the latching arrangement includes a counterweight for acting against release of the release button, the counterweight rotatably coupled to the frame, and wherein the projecting portion defines a bearing groove for receiving a portion of the counterweight.

10. A seatbelt buckle device of a seatbelt system, seatbelt buckle device comprising:

a housing;

a frame disposed within the housing and including first and second longitudinally extending side walls defining first and second longitudinally extending grooves, respectively;

a latching arrangement operatively associated with the frame for selectively retaining a latch plate within the housing, the latching arrangement including a counterweight rotatably coupled to the frame; and a release button movable within the housing between a latched position and an unlatched position, the release button including a proximal end laterally extending between first and second laterally spaced apart legs, a projecting portion distally extending from the proximal end and defines a groove for receiving a portion of the counterweight, first and second guiding portions distally extending from the proximal end and slidingly received in the first and second longitudinally extending grooves, respectively, and first and second shield members laterally disposed between the projecting portion and the first and second laterally spaced apart legs, respectively, the first shield member laterally spaced from the first laterally spaced apart leg by a first gap and the second shield member laterally spaced from the second laterally spaced apart leg by a second gap, the first and second gaps sized to receive the first and second longitudinally extending side walls of the frame, respectively.

11. The seatbelt buckle device of claim 10, wherein the groove defined by the projecting portion for receiving a portion of the counterweight is laterally disposed between the first and second shield members.

12. The seatbelt buckle device of claim 10, wherein the first and second shield members are generally planar in shape.

13. The seatbelt buckle device of claim 10, wherein the projecting portion includes a ramped distal end.

14. The seatbelt buckle device of claim 13, wherein the ramped distal end of the projecting portion distally extends beyond the first and second shield members.

15. The seatbelt buckle device of claim 10, wherein the first and second shield members have a shield member thickness and the projecting portion has a projecting portion thickness between the first and second shield members, the shield member thickness being less than the projecting portion thickness.

16. The seatbelt buckle device of claim 15, wherein the release button includes first and second guiding portions inwardly extending from the first and second laterally spaced apart legs, respectively, the first and second guiding portions received in longitudinally extending grooves formed in the first and second side walls, respectively, of the frame.

17. The seatbelt buckle device of claim 16, wherein a first lateral distance between the projection portion and the first laterally spaced apart leg is shielded in a downward direction by the first shield member the first guiding portion and a second lateral distance between the projection portion and the second laterally spaced apart leg is shielded in the downward direction by the second shield member the second guiding portion.

18. The seatbelt buckle device of claim 17, wherein the first guiding portion has a first width at least as great as the first gap and the second guiding portion has a second width at least as great as the second gap.

* * * * *